United States Patent [19]

Shimoma

[11] 4,238,751

[45] Dec. 9, 1980

[54] DEFLECTION YOKE FOR COLOR PICTURE TUBE

[75] Inventor: Taketoshi Shimoma, Fukaya, Japan

[73] Assignee: Tokyo Shibaura Electric Co., Ltd., Kawasaki, Japan

[21] Appl. No.: 960,625

[22] Filed: Nov. 14, 1978

Related U.S. Application Data

[63] Continuation of Ser. No. 772,938, Feb. 28, 1977, abandoned.

[51] Int. Cl.[3] ..... H01F 5/00

[52] U.S. Cl. ..... 335/213; 335/212

[58] Field of Search ..... 335/213, 212, 210

[56] References Cited

U.S. PATENT DOCUMENTS 2,569,343 9/1951 Scull, Jr. ..... 335/213

*Primary Examiner*—Harold Broome

*Attorney, Agent, or Firm*—Oblon, Fisher, Spivak, McClelland & Maier

[57] ABSTRACT

In a plural beam color picture tube, convergence of the beams is achieved by means of non-uniform main deflection fields and of induced flux fields. For this purpose, a pair of supplementary coils are disposed adjacent the toroidally-shaped high permeability magnetic core on which the horizontal windings are turned.

3 Claims, 11 Drawing Figures

DEFLECTION YOKE FOR COLOR PICTURE TUBE

This is a continuation, of application Ser. No. 772,938, filed Feb. 28, 1977, now abandoned.

BACKGROUND OF THE INVENTION

Field of the Invention

This invention relates to a deflection yoke for color picture tubes of the type suitable for displaying a color television representation and more particularly to an improvement of such a deflection yoke that requires a less complex dynamic convergence system.

As is well known, in a color picture tube used for color television, three electron beams are produced from an electron gun which is mounted in the neck portion of the tube. To provide a picture, all of the three electron beams must be deflected over the area of the tube screen by the magnetic field of the deflection yoke.

In a shadow mask type color picture tube, for good color picture reproduction it is important that as the beams scan the screen they converge for every point on the color selection shadow mask. Conventionally, the electron gun for a shadow mask type color picture tube is constructed so that the three electron beams converge at the center of the mask or the screen with no deflection field applied. However, when the three beams are deflected over the screen, the point of convergence shifts from the shadow mask surface toward the electron gun and the locus of the point of convergence is generated inside of the mask surface facing the electron gun. Accordingly, for good picture reproduction, it has been customary to employ pre-deflection to achieve the necessary dynamic convergence of the three electron beams. Such dynamic convergence requires the generation of complex parabolic correction signals of proper amplitude and phase relative to the sweep currents in the deflection yoke.

It is also known that the convergence problems associated with such a color picture tube can be simplified somewhat through the use of a deflection yoke producing a non-uniform deflection field. Especially, such a simplification of dynamic convergence can easily be achieved in the case of the plural in-line beams color picture tube in which the three electron beams are arranged in one direction, since dynamic convergence is not required in the direction normal to the plane in which the electron beams lie.

It is also known that for one direction of deflection in an in-line beams color picture tube the meridianal image plane is substantially coincident with the surface of the screen, and for the other direction of deflection the sagittal image plane is substantially coincident with the surface of the screen. To this end, it is common to use a strong pin-cushion shaped horizontal deflection field and a strong barrel shaped vertical deflection field.

However, since the curvature of the sagittal image plane and that of the meridianal image plane are not constants, but functions of deflection distance and of magnetic field distribution, it is impossible to make the focus plane of three beams converging point completely circular. On the other hand, the mask has a single curvature in one direction. Consequently, it is theoretically impossible to determine the magnetic field distribution such that the focus plane of the beams coincides completely with the mask surface. In other words, even with the winding distribution of the deflection yoke improved, it is inevitable that divergence appears between the mask surface and the focus plane of the three beams.

SUMMARY OF THE INVENTION

Accordingly, an object of the invention is to provide an improved deflection yoke for a color picture tube employing plural electron beams.

Another object is to provide an improved deflection yoke for color picture tube for simplifying dynamic convergence.

A further object of this invention is to provide an improved deflection yoke for plural in-line beams color picture tube which completely eliminates the need for complex dynamic convergence signals and minimizes convergence error.

These and other objects achieved in one embodiment of the invention through the use of a deflection yoke which is comprised of a toroidally-shaped magnetic core of high permeability, a pair of vertical windings having turns wound on the core for providing a main field to deflect the electron beams in a vertical direction, a pair of horizontal windings having turns wound on the core for providing a main field FIG. 4*a* shows the deflection of electron beams toward the face plate 1. FIG. 4*b* shows the corresponding deflection field to deflect the electron beams in a horizontal direction, and a pair of supplementary coils having predetermined turns disposed adjacent the horizontal windings for providing an induced flux field which couples magnetically with the main field of the horizontal windings so as to decrease the field intensity of the center portion of the main field but to enhance the field intensity of the edge portions of the main field. In this manner, substantial convergence of the three electron beams is achieved without the necessity for dynamic convergence signals.

The features of the present invention which are believed to be novel are set forth with particularity in the appended claims.

BRIEF DESCRIPTION OF THE DRAWINGS

The invention, together with further advantages thereof, may best be understood by reference to the following description taken in conjunction with the accompanying drawings in the several figures of which like reference numerals designate the same or similar parts, and in which;

FIGS. 1, 2 and 3 serve to explain the relationship between the distribution of the deflection field and the convergence error of the three electron beams.

DESCRIPTION OF THE PREFERRED EMBODIMENT

Referring to FIGS. 1, 2 and 3, the conventional convergence operation for plural in-line beams color picture tube will be explained. As mentioned before, convergence of plural beams arraged in-line can be simplified by the use of an increasingly stronger pincushion-shaped horizontal deflection field and of an increasingly stronger barrel-shaped vertical deflection field. These deflection fields are substantially determined according to the winding distributions of the deflection yoke.

Figure 1A:
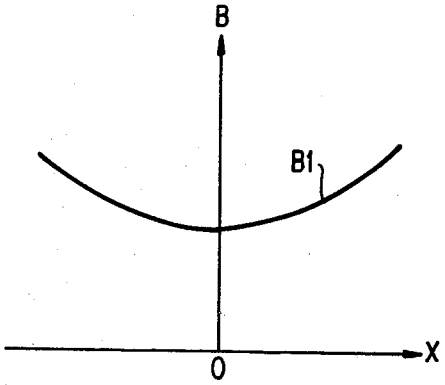
FIGS. 1*a* and 1*b* show the essentially pincushion shaped deflection fields in the horizontal deflection windings.
Figure 1B:
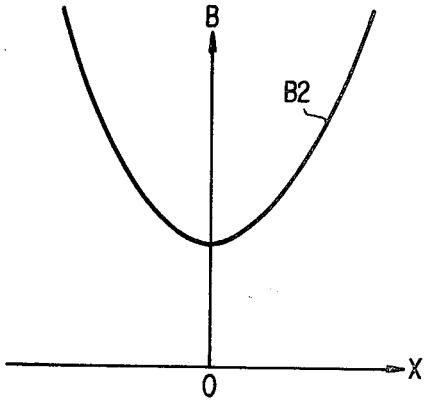

Though the curvature of the three beams converging points is a function of the non-uniformity of these deflection fields, for convenience, the horizontal field alone is illustrated in FIGS. 1*a* and 1*b*.

As shown in FIGS. 1*a* and 1*b*, the horizontal deflection field intensity B increases with horizontal distance from the tube axis. FIG. 1*a* depicts a relatively weak pincushion-shaped field B1 and FIG. 1*b* is a relatively strong pincushion-shaped field B2.

Figure 2A:
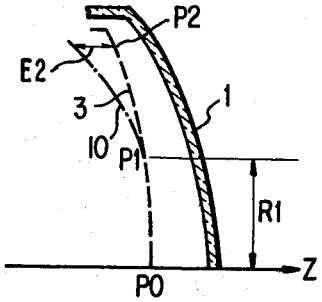
FIGS. 2*a* and 2*b* show the image fields of the three electron beams with the horizontal fields of FIGS. 1*a* and 1*b* are applied, respectively.
Figure 2B:
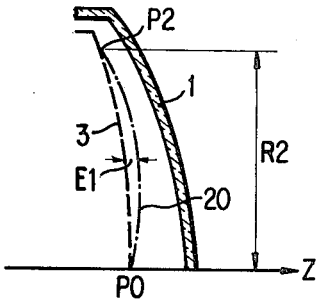
Figure 3A:
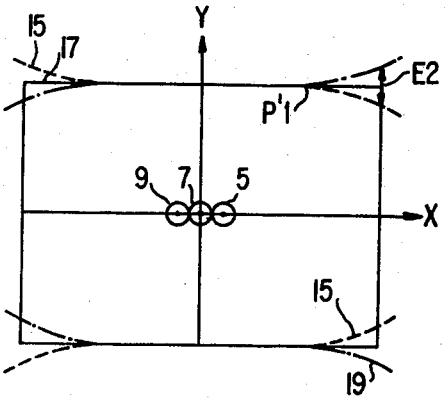
FIGS. 3*a* and 3*b* show the convergence errors appeared on the screen by the image field of FIGS. 2*a* and 2*b*, respectively.
Figure 3B:
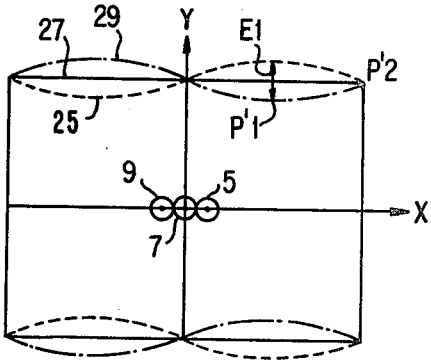

FIGS. 2*a* and 2*b* are horizontal cross-sectional views for illustrating the focus points of the three beams, and which appear in case the horizontal fields of FIGS. 1*a* and 1*b* are applied, respectively. The face plate 1 of a color picture tube and the shadow mask 3 each have a horizontal curvature. As illustrated in the figure, if a relatively weak pincushion-shaped field B1 is applied, the intersection point P1 of the shadow mask surface and the curvature of the three beams converging points lies between the mask center P0 and the mask edge portion P2. But, the curvature 10 of the three beams converging points deviates from the mask surface 3 in the direction of the electron gun (not shown), so that a separation E2 appears between them at the mask edge portion. In this case, the convergence error E2 appears at the screen edge portions as shown in FIG. 3*a*. In FIGS. 3*a* and 3*b*, the dotted lines 15 and 25 show raster lines of the electron beam dispersed from the electron gun 5. The straight lines 17 and 27 are the raster of the electron gun 7, and the chain lines 19 and 29 are the raster of the electron gun 9.

On the other hand, as shown in FIG. 2*b*, if the pincushion field intensity B2 is determined so that the respective intersecting points P0 and P2 lie at the mask center and the mask edge, a separation E1 appears between them. In this case, the raster convergence error E1 appears as shown in FIG. 3*b*.

For example, in a 20-inch size in-line type color picture tube, the distance R1 between the converging point P1 and the tube axis Z is about 110 mm and the distance R2 of the converging point P2 is about 220 mm. The convergence errors E1 and E2 are about 2.5 mm.

Usually, the practical ranges in which the convergence error is permitted are $0 \leqq E1 < 1.0$ mm and $0 \leqq E2 < 1.5$ mm, respectively. So, in the conventional technique, the deflection yoke is designed so that the intersecting point lies between the points P1 and P2. In this case, the convergence errors E1 and E2 become about 1.0 mm and 1.5 mm, respectively. Consequently, these convergence errors are at the very limit of reduction and it is impossible to improve them further.

Figure 4A:
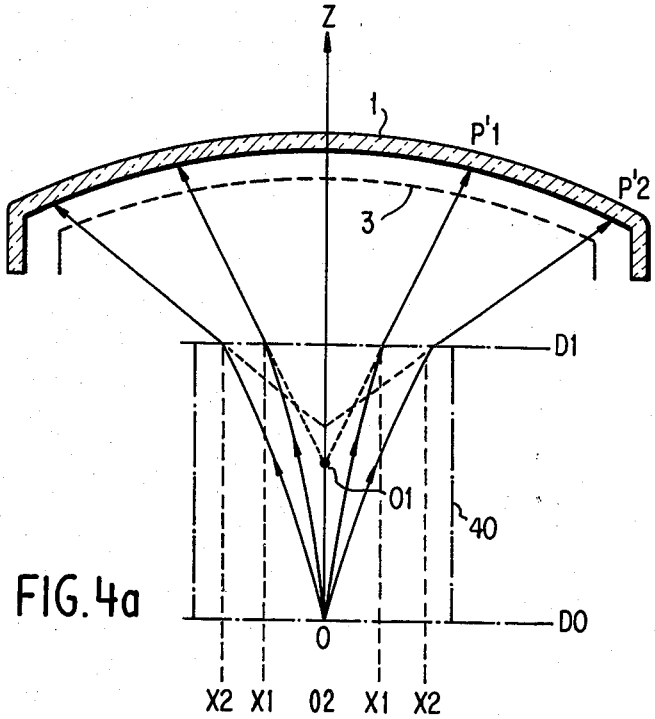
FIG. 4 serves to explain the basic concept for eliminating the convergence errors which appear in the non-uniform deflection field.
Figure 4B:
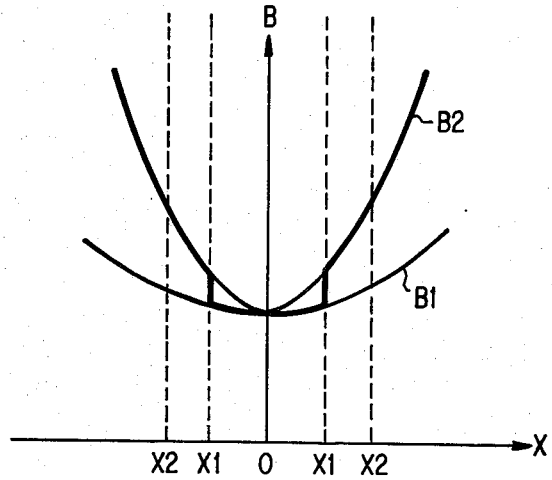

As illustrated in FIGS. 3*a* and 3*b*, if the relatively weak pincushion field B1 is applied, the convergence error increases between the screen intermediate point P'1 and the screen edge point P'2. On the contrary, it decrease between them in the case when the relatively strong pin-cushion field B2 is applied. Accordingly, if it is possible to change the field intensity partially as shown in FIG. 4*b*, the convergence error can be decreased. That is, if the pin-cushion field intensity is markedly changed from B1 to B2 at the horizontal location X1, an ideal convergence system can be achieved. The location X1 is the beam releasing point on the top of the deflection plane D3 which goes straight toward the point P1 on the mask 3. In FIG. 4*a*, the chain line 40 shows the deflection field area in which the electron beams are gradually deflected toward the face plate 1. The points 01 and 02 show the imaginary deflection centers from which the electron beams are emitted to impinge on the screen points P'1 and P'2, respectively.

This is a basic analysis of this invention. However, in practice, it is impossible to change the field intensity partially as shown in FIG. 4*b* by controlling the deflection yoke winding distribution alone.

Figure 5A:
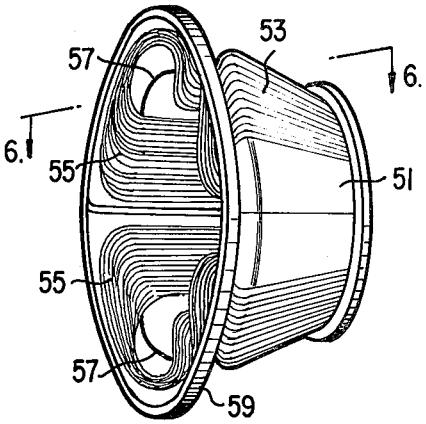
FIG. 5*a* is a perspective view of an embodiment of the deflection yoke in accordance with the invention.
Figure 5B:
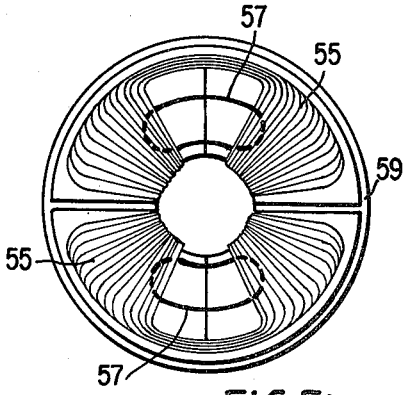
FIG. 5*b* is a front representation of FIG. 5*a*.

Under these considerations, this invention is achieved. Referring to FIGS. 5*a* and 5*b*, one embodiment of this invention is explained. FIG. 5*a* shows a perspective view of the inventive deflection yoke, and FIG. 5*b* is a plan view of FIG. 5*a*.

According to this invention, a deflection yoke for a color picture tube comprises a toroidally-shaped core 51 of high permeability, a pair of vertical windings 53 having turns wound on the core 51 for providing a main field to deflect the electron beams in a vertical direction, a pair of horizontal windings 55 having turns wound on the core for providing a main field to deflect the electron beams in a horizontal direction which are separated from the vertical windings 53 by the plastic mold separator 59, and a pair of supplementary coils 57 having predetermined turns disposed adjacent the horizontal windings 55 for providing an induced flux field which couples magnetically with the main field of the horizontal windings 55. The supplementary windings 57, as shown in FIGS. 5*a* and 5*b*, are symmetrically arranged relative to a horizontal plane containing the electron gun of the color picture tube and are symmetrically arranged relative to a vertical plane which is perpendicular to the horizontal plane and which includes the central electron beam of the three beams produced by the electron gun.

The inventive yoke is characterized by a pair of supplementary coils 57 having predetermined turns, shapes and sizes.

In the embodiment of FIG. 5, a pair of short rings 57 are symmetrically arranged along a horizontal deflection axis. These short rings form a closed circuit which couples magnetically with the horizontal deflection field provided from the windings 55.

Figure 6:
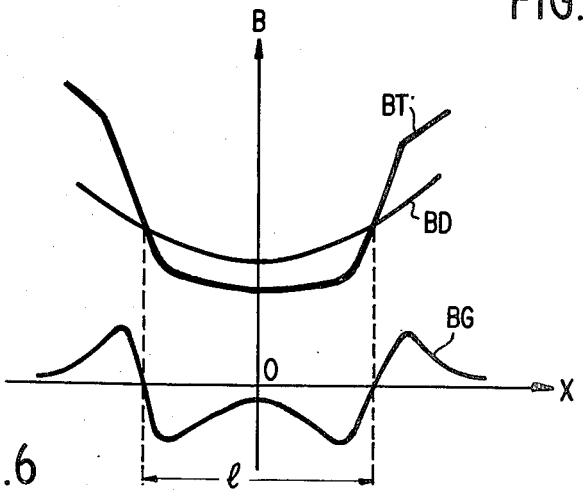
FIG. 6 shows the field intensity in accordance with the inventioned deflection yoke.

FIG. 6 shows a field intensity distribution in a cross-sectional deflection plane along line 6—6. The deflection flux field $B_D$ is obtained with no supplementary coils disposed. In the case supplementary coils are disposed, an induced flux field $B_G$ is produced as shown in FIG. 6. Distance l shows a diameter of the supplementary coil. As disclosed in the figure, the induced flux field distribution $B_G$ is produced so as to decrease the deflection field intensity $B_D$ at the inside portion of the supplementary coil but to enhance the field intensity $B_D$ at the outside poritons of it.

As a result, the deflection field distribution $B_T$ can be obtained. That is, a pair of supplementary coils are disposed adjacent the horizontal deflection windings and they produce an induced flux field which couples magnetically with the deflection field so as to decrease the center portion of the main deflection field but to enhance the edge portions of the one whereby the curvature of the meridianal image plane of the in-line arranged three electron beams is substantially coincident with the curvature of the shadow mask surface.

In this embodiment, each of the supplementary coils 57 comprises a short ring and is disposed between the horizontal deflection windings 55 and the separator 59. But, it is possible to arrange the supplementary coils on the horizontal deflection windings 55. Further it is possible to position them between the separator 59 and the vertical deflection windings 53.

Furthermore, it is possible to make the supplementary coils so as to be capable of opening the closed circuit for adjusting the various convergence errors.

This invention is applicable to the deflection yoke in the delta gun type color picture tube and in that case, a pair of the supplementary coils are asymmetrically arranged along a plane.

As explained above, according to this invention, by adjusting the supplementary coils diameter, turns and shapes, convergence error can be almost eliminated.

Obviously, numerous modifications and variations of the present invention are possible in light of the above teachings. It is therefore to be understood that within the scope of the appended claims, the invention may be practiced otherwise than as specifically described.

What is claimed as new and desired to be secured by letters patent of the United States is:

1. In a color picture tube having an electron gun arranged in a horizontal plane for emitting three electron beams toward a viewing screen through a shadow mask, a deflection yoke comprising:

a toroidally-shaped magnetic core of high permeability;

a pair of vertical windings having toridal-shaped turns wound on said core for providing a non-uniform main field to deflect said electron beams in a vertical direction;

a pair of horizontal windings having turns wound on said core for providing a non-uniform main field to deflect said electron beams in a horizontal direction; and a pair of supplementary coils having predetermined turns and proper shapes disposed adjacent said horizontal windings for providing an induced flux field which couples magnetically with said main field of said horizontal windings so as to decrease the center portion of said main field but to enhance the edge portions thereof, said supplementary coils being symmetrically arranged relative to said horizontal plane and relative to a plane being perpendicular to said horizontal plane which includes the central electron beam of said three electron beams such that the curvature of the meridinal image plane of said electron beams is substantially coincident with the curvature of said shadow mask surface.

2. The deflection yoke recited in claim 1 wherein each of said supplementary coils comprises a short ring.

3. The deflection yoke recited in claim 1 wherein each of said supplementary coils comprises a closed circuit.

* * * * *